US007165989B2

(12) United States Patent
Huang et al.

(10) Patent No.: US 7,165,989 B2
(45) Date of Patent: Jan. 23, 2007

(54) MINI-USB TYPE ELECTRICAL CONNECTOR WITH LATCHING ARRANGEMENT

(75) Inventors: Shang-Yen Huang, Taipei Hsien (TW); Sheng-Ho Yang, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/011,173

(22) Filed: Dec. 15, 2004

(65) Prior Publication Data

US 2006/0035520 A1 Feb. 16, 2006

(30) Foreign Application Priority Data

Aug. 13, 2004 (TW) ..... 93212945 U

(51) Int. Cl.
*H01R 13/625* (2006.01)
*H01R 4/50* (2006.01)
*H01R 13/648* (2006.01)

(52) U.S. Cl. ..... 439/346; 439/607

(58) Field of Classification Search ..... 439/610, 439/607, 108, 346, 355, 362
See application file for complete search history.

(56) References Cited

U.S. PATENT DOCUMENTS

| | | | | |
|---|---|---|---|---|
| 4,990,094 | A * | 2/1991 | Chandler et al. | 439/108 |
| 5,092,794 | A * | 3/1992 | Kachlic | 439/607 |
| 5,397,250 | A * | 3/1995 | Briones | 439/620 |
| 5,980,320 | A * | 11/1999 | Slack et al. | 439/607 |
| 6,099,351 | A * | 8/2000 | Wu | 439/607 |
| 6,142,828 | A * | 11/2000 | Pepe | 439/610 |
| 6,612,868 | B2 * | 9/2003 | Hwang | 439/607 |

* cited by examiner

*Primary Examiner*—Chandrika Prasad
(74) *Attorney, Agent, or Firm*—Troxell Law Office, PLLC

(57) ABSTRACT

Provided is an electrical connector such as a mini-USB type electrical connector comprising a conductor assembly, an insulating housing for receiving the conductor assembly, and a metal shroud for enclosing the housing and comprising a provided flexible cantilever snap lugs on its top, and a provided latches on the sides other than the top. The flexible cantilever snap lugs and the latches are adapted to couple to mating portions of a mated port on an electronic or electrical device. The invention can carry out a stable coupling of the connector to the port improve signal communication quality, and prolong a useful life.

6 Claims, 2 Drawing Sheets

MINI-USB TYPE ELECTRICAL CONNECTOR WITH LATCHING ARRANGEMENT

BACKGROUND OF THE INVENTION

1. Field of the Invention

The present invention relates to electrical connectors and more particularly to a latching arrangement provided in a mini-USB (Universal Serial Bus) type electrical connector such that the electrical connector is adapted to reliably secure to a mated port formed on an electronic or electrical device by means of the latching arrangement.

2. Description of Related Art

Mini-USB type electrical connectors are widely provided in newly available notebooks due to technological advancements of electronics. Such mini-USB type electrical connectors are gaining popularity due to its compactness and other advantageous electrical characteristics. However, many problems still exist in the manufacturing process and the insertion stability of mini-USB type electrical connector as detailed below.

Reliable fastening of an electrical connector in a mated port on an electronic or electrical device is very important. For example, a mini-USB type electrical connector or so-called male connector comprises an insulating housing, a conductor assembly in the housing, and a metal shroud for enclosing the housing.

However, the coupling of the connector and a port formed on an electronic or electrical device tends to become loose because, for example, there are a number of flexible cantilever snap lugs provided on the shroud and unfortunately the flexible cantilever snap lugs are not robust enough to provide a stable fastening to the coupled connector and port. As such, the connector, attached to a cable, is provided externally to the coupled device and is thus subject to disengagement in the process of pulling the cable. This can cause a poor electrical contact therebetween. It is understood that the times of plugging and/or unplugging the mini-USB type electrical connector is larger than that of a conventional electrical connector. Thus, the mini-USB type electrical connector incorporating the conventional construction cannot ensure a stable connection because the flexible cantilever snap lugs of the connector may suffer elastic fatigue after a predetermined times of use and the coupling of the connector and the port may be compromised by inadvertently pulling the cable. Thus, continuing improvements in the exploitation of the mini-USB type electrical connector are constantly being sought.

SUMMARY OF THE INVENTION

It is an object of the present invention to provide a latching arrangement for an electrical connector having advantages of robust components, reduced manufacturing cost, and improved electrical characteristics.

To achieve the above object, the present invention provides an electrical connector comprising a conductor assembly comprising a provided conductors; an insulative housing formed by injection molding of thermoplastic material and comprising a provided parallel grooves in its rear for receiving the inserted conductors, two troughs provided at both sides, and a slot above either trough, the slots adapted to position the housing; and a metal shroud formed integrally from a metal sheet for enclosing the housing and comprising a provided flexible cantilever snap lugs on its top, two tabs on its both sides, the tabs adapted to insert into the slots for fastening, two bent members extended downward, inward from the tabs, the bent members adapted to matingly engage with the troughs for preventing the housing from being displaced vertically, a bottom having a reduced width, and a provided latches projected rearward from the bottom, wherein the flexible cantilever snap lugs and the latches are adapted to couple to mating portions of a coupled port on an electronic or electrical device. By utilizing this, the coupling of the electrical connector to the port is stable, signal communication quality is improved, and useful life is prolonged.

The above and other objects, features and advantages of the present invention will become apparent from the following detailed description taken with the accompanying drawings.

DETAILED DESCRIPTION OF THE PREFERRED EMBODIMENTS

Figure 1:
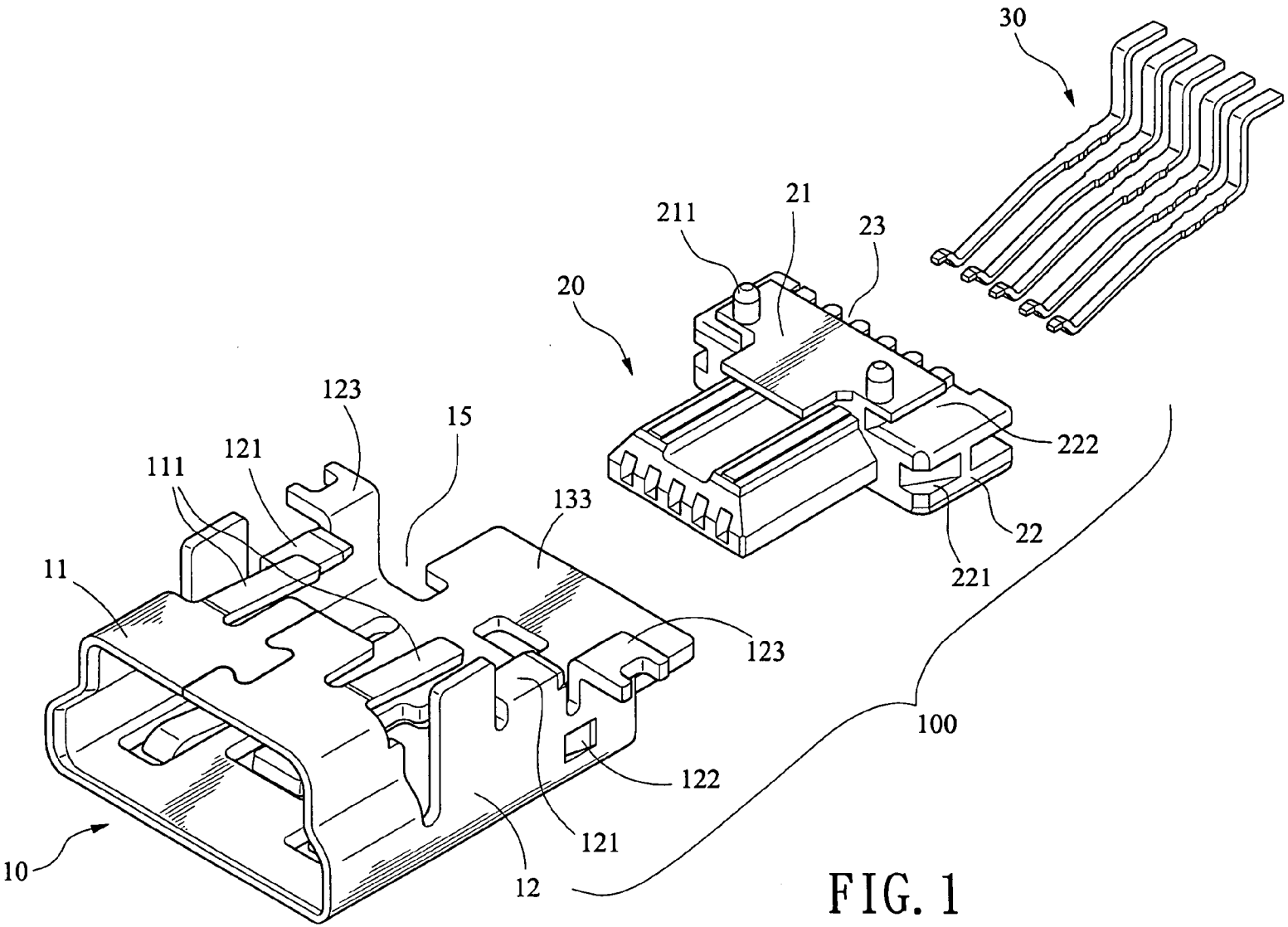
FIG. 1 is an exploded perspective view of a preferred embodiment of electrical connector according to the invention.
Figure 2:
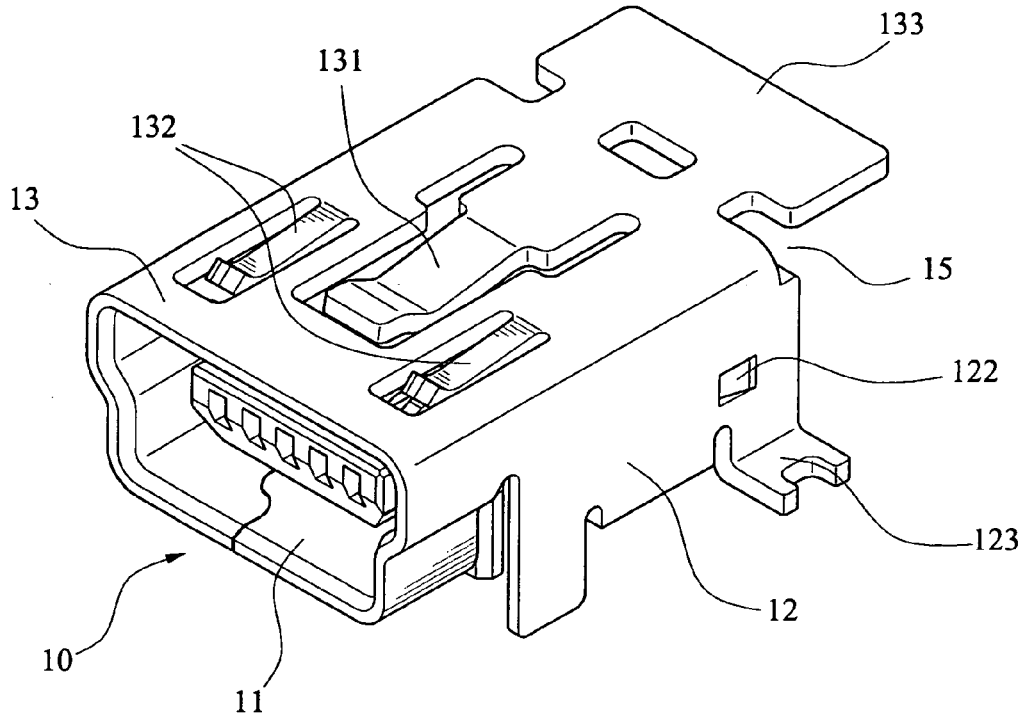
FIG. 2 is a perspective view of the metal shroud viewed opposing the same shown in FIG. 1.
Figure 3:
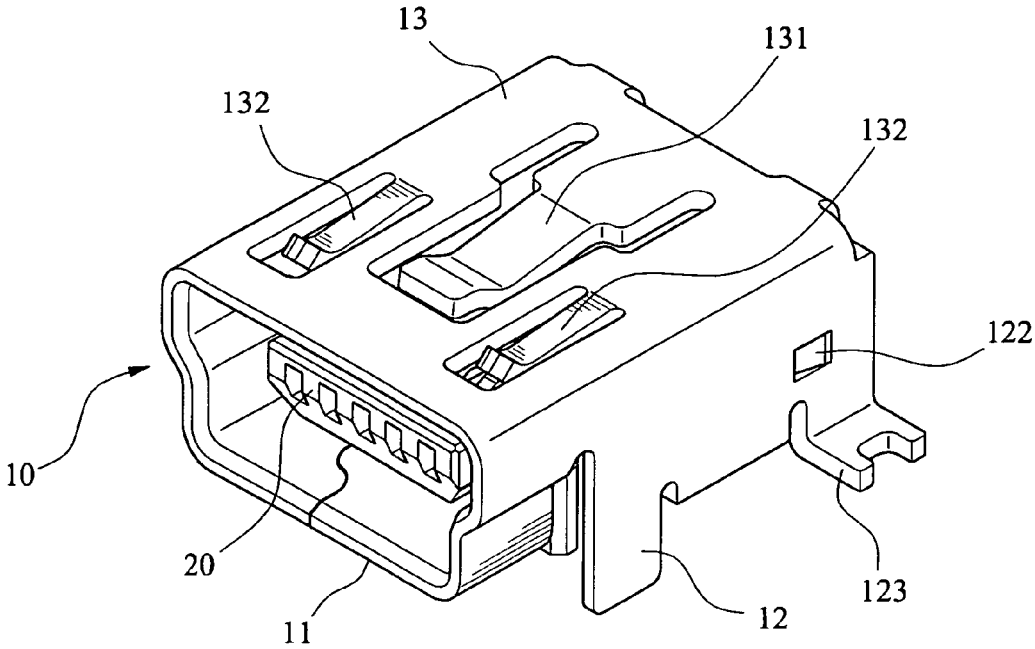
FIG. 3 is a perspective view of the assembled electrical connector of FIG. 1.

Referring to FIGS. 1, 2 and 3, there is shown a mini-USB type electrical connector 100 incorporating a latching arrangement in accordance with a preferred embodiment of the invention. The electrical connector 100 comprises an insulating housing 20, a conductor assembly 30 mounted in the housing 20, and a metal shroud 10 for enclosing the housing 2. Each component will be described in detailed below.

The housing 20 is formed by injection molding of thermoplastic material and comprises a short T-shaped bottom plate 21 and a long T-shaped body wherein parallel grooves 23 extending from its rear to its front for receiving the inserted conductors of the conductor assembly 30, two legs 211 each proximate either side on the short T-shaped bottom plate 21, the legs 211 each adapted to position into a hole on a PCB (printed circuit board)(not shown), two troughs 222 provided at both sides above T-shaped bottom plate 21, and a slot 221 above each of the two trough 222, the slots 221 adapted to position into the tabs 122 of the metal shroud 10 when the housing 20 is assembled with the shroud 10 as detailed later.

The shroud 10 is formed integrally from a metal sheet and comprise a first flexible cantilever snap lug 131 on its top 13, two second flexible cantilever snap lugs 132 on both sides of the first flexible cantilever snap lug 131, each second flexible cantilever snap lug 132 being smaller than the first flexible cantilever snap lug 131, a rear extension 133 adapted to bend to cover a rear opening 15 after inserting the housing 20 into the shroud 10 via the opening 15, two tabs 122 on both sides 12 adjacent the opening 15, the tabs 122 adapted to insert into the slots 221 for fastening (i.e., lengthwise movement of the housing 20 is prohibited), two first bent members 123 extended downward, outward from the tabs 122, and two second bent members 121 extended downward, inward from the tabs 122, the second bent member 121 being spaced from the first bent member 123 by a gap, the second bent members 121 adapted to matingly engage with the troughs 222 for preventing the housing 20 from being displaced vertically.

A bottom 11 of the shroud 10 has a reduced width. Two spaced latches 111 are projected rearward from the bottom 11. The provision of the latches 111 and the first and second flexible cantilever snap lugs 131 and 132 aims at enhancing the coupling of the electrical connector 100 to a mated port formed on an electronic or electrical device, resulting in a reliable fastening (i.e., improved stability of a connecting portion of the electrical connector and the device) and thus obtaining other benefits such as improved signal communication quality, prolonged useful life, and etc. It is contemplated that the latches 111 can be provided either on the sides 12 or on both the bottom 11 and the sides 12 in other embodiments.

The assembly of the electrical connector 100 comprises inserting the conductors of the conductor assembly 30 into the grooves 23, inserting the housing 20 into the shroud 10 from the rear opening 15 with the tabs 122 secured to the slots 221 (i.e., lengthwise movement of the housing 20 is prohibited) and the second bent members 121 secured to the troughs 222 (i.e., vertical movement of the housing 20 is prohibited), and finally bending the rear extension 133 to cover the rear opening 15.

While the invention herein disclosed has been described by means of specific embodiments, numerous modifications and variations could be made thereto by those skilled in the art without departing from the scope and spirit of the invention set forth in the claims.

What is claimed is:

1. An electrical connector comprising:

a) conductor assembly;

b) an insulative housing having a short T-shaped bottom plate and a long T-shaped body integrally formed wherein a plurality of parallel grooves extending from a rear to a front thereof for receiving the conductor assembly, two troughs located on opposing sides thereof above the short T-shaped bottom plate, and a slot above each of the two troughs, for positioning the insulative housing, the conductor assembly is inserted into the plurality of parallel grooves; and c) a metal shroud enclosing the insulative housing and comprising a first flexible cantilever snap lug located on a top thereof, two second flexible cantilever snap lugs located on opposing sides of the first flexible cantilever snap lug, two spaced latches, each of the two spaced latches extending from a bottom of the shroud, wherein the first flexible cantilever snap lug, the two second flexible cantilever snap lugs, and the latches selectively coupling the electrical connector to mating portions of a mated port on a device.

2. The electrical connector of claim 1, wherein the shroud further comprises:

a) a rear opening; and b) two tabs, one of the two tabs is located in each of two opposing sides adjacent the rear opening thereof, one of the two tabs is inserted into each slot of the housing preventing a lengthwise movement of the housing.

3. The electrical connector of claim 2, wherein the shroud further comprises:

a) two first bent members, one of the two first bent members extending downwardly and outwardly from each of two opposing sides thereof adjacent one of the two tabs; and b) two second bent members, one of the two second bent members extending downwardly and inwardly from each of two opposing sides thereof adjacent one of the two tabs, one of the two second bent members being spaced from each of the two first bent members by a gap, one of the two second bent members matingly engaging with one of the two troughs of the housing preventing a vertical displacement of the housing.

4. The electrical connector of claim 1, wherein the each of the two second flexible cantilever snap lugs is smaller than the first flexible cantilever snap lug.

5. The electrical connector of claim 1, wherein the insulative housing further comprises two legs located on opposing sides of the short T-shaped bottom plate of the housing, the two legs each inserted into a hole of a printed circuit board.

6. The electrical connector of claim 1, wherein the shroud further comprises a rear extension bent and covering a rear opening after inserting the housing into the shroud through the opening.

* * * * *